US005967684A

United States Patent [19]

Huang et al.

[11] Patent Number: 5,967,684

[45] Date of Patent: Oct. 19, 1999

[54] PEN WITH PUSH-BUTTON

[76] Inventors: Kuang-Yen Huang; Tsung-Yi Yang, both of No. 13, Alley 97, Fu-Ying Rd., Sin-Jung, Taiwan

[21] Appl. No.: 09/138,265

[22] Filed: Aug. 21, 1998

[51] Int. Cl.[6] ..... B43K 7/00; B43K 25/02

[52] U.S. Cl. ..... 401/99; 24/11 R; 24/11 F; 24/11.005; 24/11 P; 401/117

[58] Field of Search ..... 401/99, 117, 103, 401/104; 24/11 R, 11 PP, 11 CC, 11 CT, 11 S, 11 C, 11 F, 11 M, 11 P

[56] References Cited

U.S. PATENT DOCUMENTS

| | | | |
|---|---|---|---|
| 1,518,822 | 12/1924 | Saadi | 401/99 X |
| 3,101,075 | 8/1963 | Johmann | 401/103 |
| 3,181,507 | 5/1965 | Dannebaum | 401/99 |
| 3,237,604 | 3/1966 | Johmann | 401/103 |
| 3,344,484 | 10/1967 | Zepell et al. | 24/11 P |
| 3,825,976 | 7/1974 | Moore | 401/104 X |
| 3,836,264 | 9/1974 | Saito et al. | 401/99 X |
| 4,381,158 | 4/1983 | Garganese | 401/99 X |
| 4,475,834 | 10/1984 | Bean | 401/99 |
| 4,601,599 | 7/1986 | Katoh | 401/99 |

FOREIGN PATENT DOCUMENTS

| | | | |
|---|---|---|---|
| 1159302 | 6/1958 | France | 401/103 |
| 71554 | 1/1960 | France | 401/103 |
| 1942979 | 3/1971 | Germany | 401/99 |
| WO96/23666 | 8/1996 | Japan | 401/99 |

*Primary Examiner*—Henry J. Recla
*Assistant Examiner*—Kathleen J. Prunner
*Attorney, Agent, or Firm*—Harrison & Egbert

[57] ABSTRACT

A pen with push button is a pen which has a button on its barrel to control the exposure or closure of its pen point. When the button is pressed down by a finger, a thimble will retract to expose the pen point; when it is released, the thimble will close the pen point. The pen has an extending and retracting mechanism composed of a thimble, a button, and a spring.

3 Claims, 4 Drawing Sheets

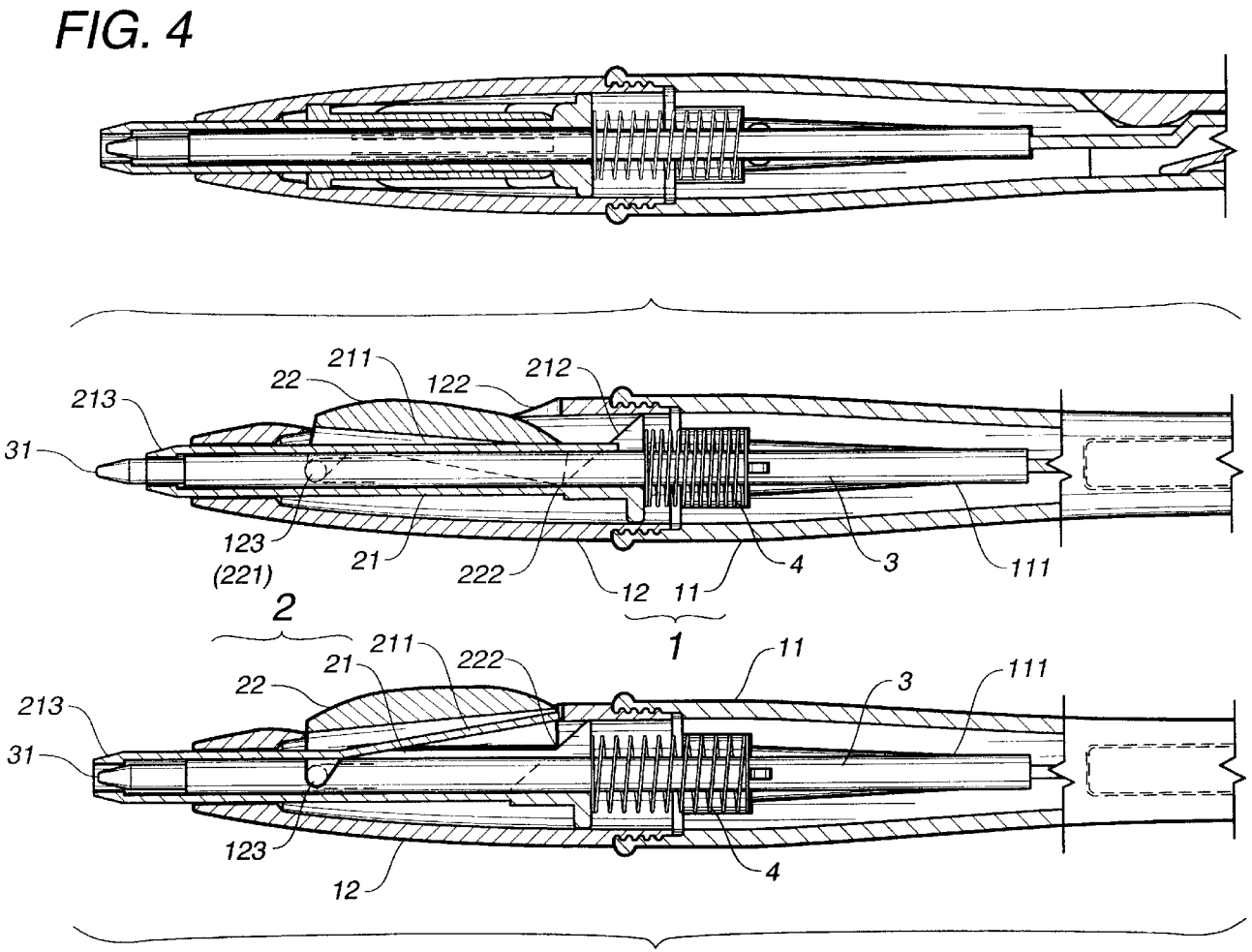
FIG. 4
FIG. 3
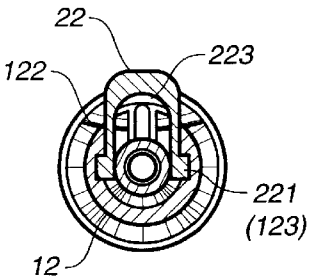
FIG. 3A

PEN WITH PUSH-BUTTON

BACKGROUND OF THE INVENTION

Nowadays almost everyone has to use a pen, especially a ball point pen, to write a report, a memo, an article, or to draw a sketch and picture in his daily life. To write with a pen is more convenient than to write with a computer. However, when a person uses a pen, he may use his body language at the same time, and so he may draw lines on his own or others' body or clothes, and that may cause some trouble, too. It is better to improve the pen to prevent clothes from being drawn upon by a pen.

PRIOR ART OF THE INVENTION

A conventional ball point pen with an extending and retracting button to control the head of the ink cartridge in or out has certain disadvantages. That is, after writing something, the user often forgets to push the button and make the pen head retract to its normal position.

FIELD OF THE INVENTION

A pen with push-button refers to a pen which uses a button to control the exposure or closure of a pen point only by means of one's fingers.

SUMMARY OF THE INVENTION

This invention has an extending and retracting thimble mechanism. The mechanism includes a thimble, a push button, and a spring, and the thimble pushed by a push button can slide along an ink cartridge. The spring can push the thimble back to its normal position; that is, the pen point is normally sleeved in the thimble, and the point of the pen exposes itself only when the push button is pushed down and the thimble is retracted into the barrel. The extending and retracting mechanism is mounted in the case. The pen point is sleeved in the end of the thimble and the front end of the thimble protrudes out of the pen point; the push button protrudes from the side portion of the barrel on which fingers often hold tight so that when the push button is held by the fingers, the pen point will be exposed, and when the fingers are released from the barrel the pen point will be sleeved into the thimble. The spring of the extending and retracting mechanism is fixed behind the thimble to push the thimble back to its normal position when the push button is released, an elastic hook is fixed on a side of the thimble to hold the barrel when the thimble returns to its normal position, and when the push button is pressed down, the hook will release the barrel so that the push button can control the sliding of the thimble.

BRIEF DESCRIPTION OF THE DRAWINGS

FIG. 3 is a sectional view of the structure of the invention (in release)

FIG. 3A is a traverse sectional view of the structure.

FIG. 4 is a sectional view of the structure of the invention (in press)

NOMENCLATURE

| | | | | | |
|---|---|---|---|---|---|
| 1 | case | 11 | upper barrel | 111 | clip hole |
| 112 | slot hole | 113 | slant face | 114 | hook groove |
| 115 | slot | 12 | lower barrel | 121 | outlet |
| 122 | push-button hole | 123 | shaft hole | (221) | shaft |
| 2 | extending & retracting mechanism | | | 21 | thimble |
| 211 | spring piece | 212 | slant wedge | 213 | tube neck |
| 22 | push-button | 222 | contact point | 223 | groove |
| 3 | ink cartridge | 31 | pen point | 4 | spring |
| 5 | pen clip | 51 | head | 511 | slant face |
| 52 | clip plate | 521 | guiding end | 53 | spring piece |
| 531 | hook | | | | |

DETAILED DESCRIPTION OF THE PREFERRED EMBODIMENT

Figure 1:
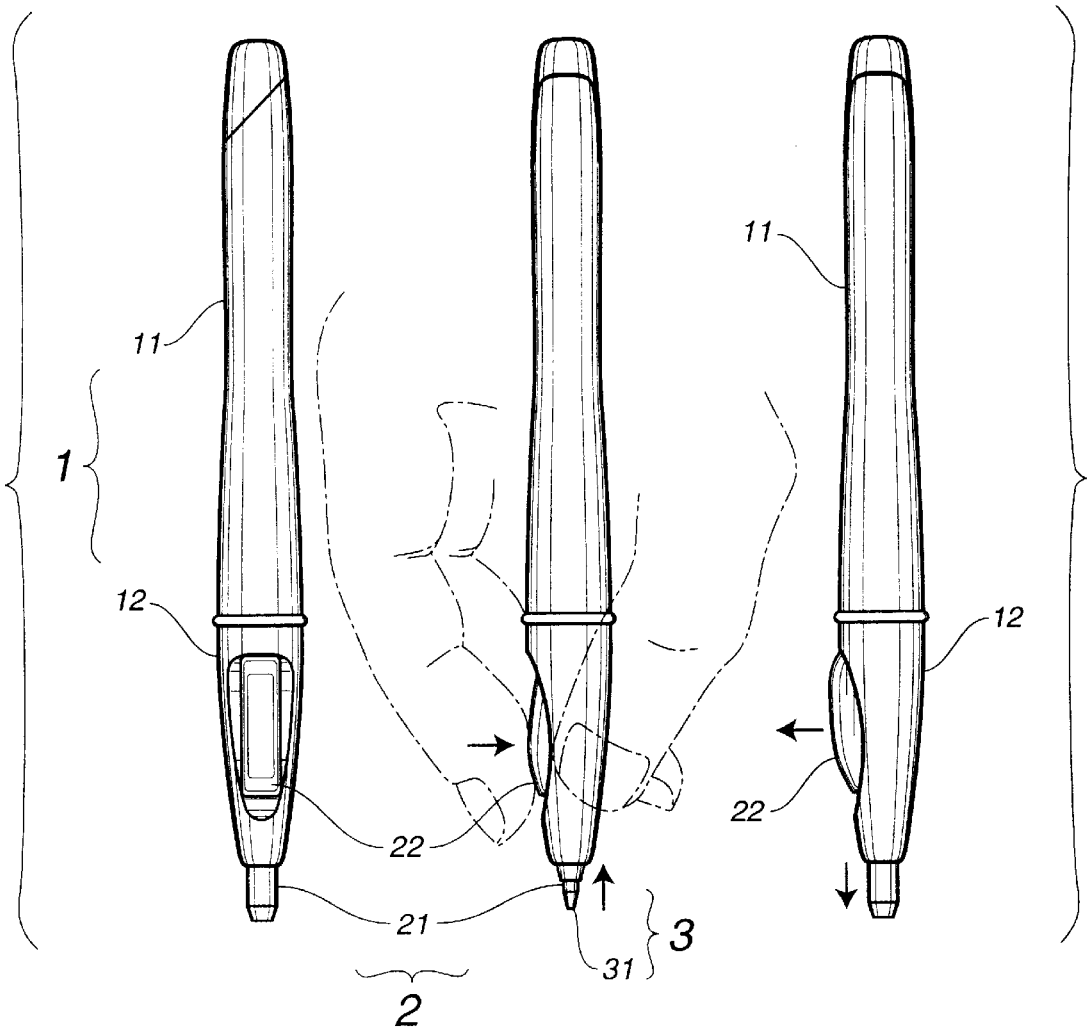
FIG. 1 is a schematic view of the exterior and the use of the invention.

As shown in FIG. 1, the pen case (1) of the invention includes an upper barrel (11) lower barrel (12), the case (1) is a hollow barrel body, the lower barrel (12) has a penetrated outlet (121) at its end for the pen point (31) to protrude out, the lower barrel (12) has a push-button hole (122) at its side used as an outlet for the push-button; the extending and retracting mechanism (2) is mounted in the case (1) wherein the lower end of the thimble (21) protrudes out of the outlet (121) and the portion of the push-button (22) on which fingers often hold also protrudes out of the push-button hole (122), and an ink cartridge (3) is disposed in the center of the case (1), a pen point (31) protrudes out of the outlet (121). As shown in FIG. 1, when a finger presses down the push-button (22), the thimble (21) retracts into the case (1) for a little distance to expose the pen point out of the thimble (21); when the finger releases the button (22), the thimble retrieves to its normal position and the pen point is sleeved into the thimble (21) again.

Figure 2:
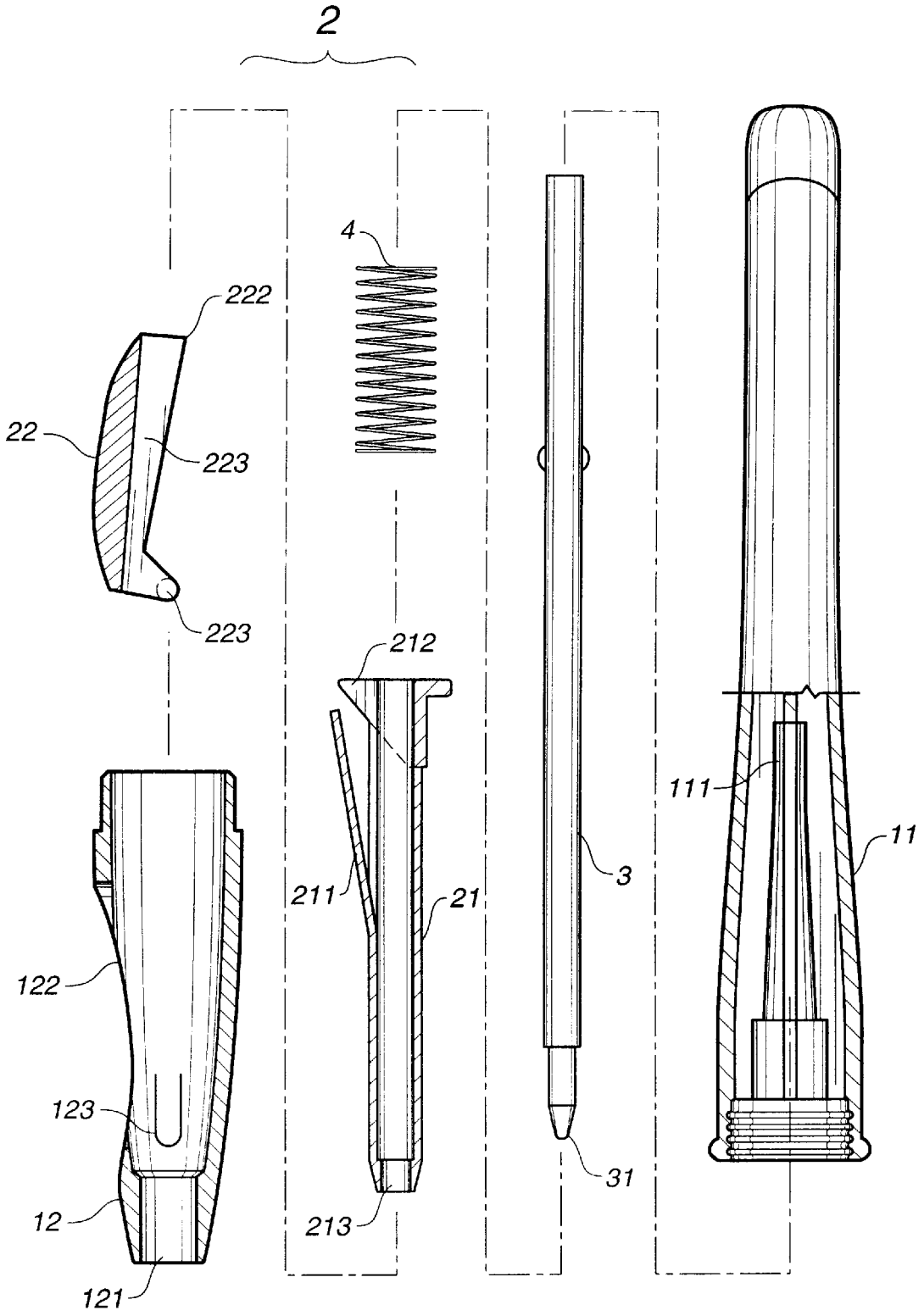
FIG. 2 is a view of the decomposition of the parts of the invention.

As shown in FIG. 2, the extending and retracting mechanism (2) includes a thimble (21), a push button (22), and a spring (4), wherein thimble (21) is composed of a hollow tube body and a slant wedge (212), the hole at the front end of the hollow tube body is a little smaller than the tube hole and so is called a tube neck (213), the inner diameter of the tube neck (213) is a little bigger than the outer diameter of the pen point (31) so that the pen point (31) can move and penetrate smoothly in the tube neck (213), a spring piece (211) is slantwise disposed on the side of the tube body, the lower end of the spring piece (211) can hold out against the lower end of the push button hole (122), the push button tends to be a sway rod and the front end of the button (22) has a shaft (221), the lower end corner of the button (22) is used as a contact point (222), the sectional face of the button (22) tends to be an arc body; that is, its bottom is a groove (223) so that the button (22) is easy to be mounted on the side of thimble (21), a slant wedge (212) is disposed at the lower end of the tube body, the slant face of the slant wedge (212) holds out against the contact point (222) of the button (22), a spring (4) is fixed on the lower end of the thimble (21); the ink cartridge (3) is sleeved in the thimble (21) at the center of the extending and retracting mechanism (2), and the upper end of the ink cartridge (3) is fixed in the upper barrel (11) of the case (1).

As shown in FIG. 3 and FIG. 4, in the inner side wall of the lower barrel (12) there disposed a shaft hole (123) for the shaft (221) of the button (22) to pivot in it. As shown in FIG. 3, the upper barrel (11) and lower barrel (12) are combined to form a hollow case (1), the ink cartridge is disposed at the center of the case (1) and its upper end is secured in the clip hole (111) in the upper barrel (11) and the pen point (31) at its lower end protrudes out of the outlet (121) of the lower barrel (12), the ink cartridge (3) is sleeved in the thimble (21) of the retracting mechanism (2), a push button (22) is mounted on the outside of the thimble (21), the shaft (221) at the front end of the button (22) is pivoted in the shaft hole (123), the contact point (222) at the lower end of the button (22) can hold out against the slant wedge (212) of the thimble (21), a spring (4) can hold out against the lower end of the thimble (21) so as to maintain and prepare the thimble (21) to move out; the above situation shows that the button (22) is not pressed down and the thimble (21) is in its normal position.

As shown in FIG. 4, when fingers press down the button (22), the contact point (222) of the button (22) moves inward along the slant face of the slant wedge (212) and pushes the thimble (21) into the case (1) to expose the pen point (31) out of the tube neck (213) of the thimble (21).

As shown in FIG. 3, when the pen is not in use, the thimble (21) is pushed back to the ultimate front position, the end of its spring piece (211) just passes over the end of the push-button hole (122) and holds out against the thimble (21) and keeps the thimble (21) from being withdrawn by itself; that is, when the thimble (21) is directly pushed, it will not retract to its normal position, unless the button (22) pushes the spring piece (211) down at first and avoids the piece (211) holding out against the lower end wall of the button hole (122), then the thimble (21) can be pushed into the case (1).

In conclusion, when fingers hold the pen and press down the button (22) to write something, the pen point (31) will be exposed and be ready to write, when fingers are released from the button (22), the pen point (31) will be sleeved by the thimble (21).

Figure 5:
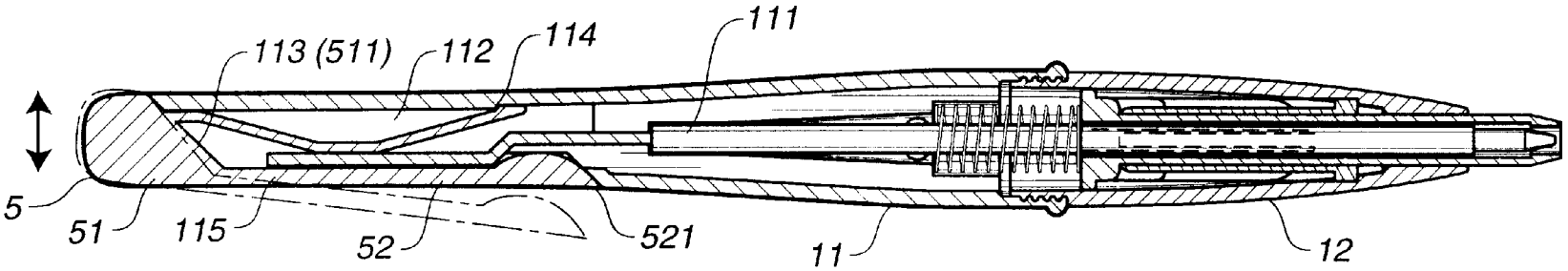
FIG. 5 is an embodiment of the structure and movement of the pen clip.

Another trait of the invention is that it has a hidden pen clip. As shown in FIG. 5, the upper end of the upper barrel (11) of the case (1) forms a slant face (113), a slot hole (112) is disposed along the slant face (113) down into the upper barrel inner wall, the slot hole (112) has a hook groove (114) on the bottom side of the hole (112), the upper barrel (11) has a slot (115) on the lower side of the upper barrel (11), a pen clip (5) has a head (51) at its upper end, the head (51) has a slant face (511) which fits the slant face (113) of the upper portion of the upper barrel (11), a clip plate (52) extends itself downward from the lower side of the head (51), an arc plate used as a spring piece (53) extends from bottom slant face (511), at the bottom of the spring piece (53) there disposed a hook (531); the head (51) of the pen clip (5) is wedge-joined with the upper portion of the upper barrel (11), the clip plate (52) just fits the groove (115), the spring piece (53) is inserted in the slot hole (112), when pen clip (5) joins with the upper barrel (11), the hook (531) at the end of the spring piece (53) hooks the hook groove (114) under the slot hole (112), and the slant face (511) of the pen clip (5) is completely wedge-joined with the slant face (113) of the upper barrel (11).

Figure 6:
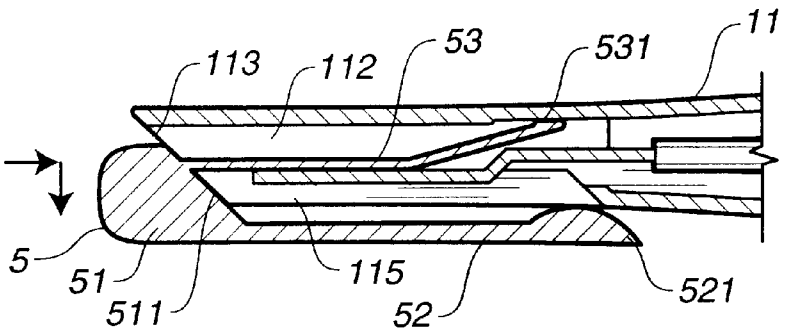
FIG. 6 is another embodiment of the movement of the pen clip.

As shown in FIG. 6, when the pen clip (5) is in use, use a finger to push the head (51) of the pen clip (5) down and the clip (5) will move along the slant face (113) to one side of the upper barrel (11) so as to expose the clip plate (52) out of the groove (115), the end of the clip plate (52) is a slant guide end easy to guide the flange of a pocket into the pen clip (5). As shown in FIG. 6, the spring piece (53) which is mounted under pen clip (5) changes its form in the slot hole (112) when it slides down and obtains greater force of clipping. To retrieve the pen clip (5), just use a finger to push the clip plate (52) backward to the opposite side of the pen clip (5) and then the clip (5) will move back to its original position and hide itself in the upper barrel (11).

Another way to use the pen clip (5) is as shown in FIG. 5. The phantom line shows that pushing the head (51) to the other side will cause the guide end (521) of the clip (52) to protrude out of the barrel (11) and be ready to clip on the flange of a pocket. The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

What is claimed is:

1. A pen with push button comprising a case, an extending and retracting mechanism, an ink cartridge wherein the case is a hollow barrel with a penetrated push-button hole on its side, having an outlet at its lower end, a pair of shaft holes in its inner wall; the extending and retracting mechanism composed of a button, a thimble, and a spring, the button tends to be a sway rod having a pair of shafts under its lower end and its other end used as a contact point; the thimble is a hollow tube body, having a taper tube neck at its one end and having a slant wedge at the other end; the button is mounted in the thimble and its shaft are pivoted in the push-button hole in the barrel, the contact point on the other end can hold out against the slant wedge on the thimble; the ink cartridge is disposed at the center of the case, the ink cartridge is sleeved into the extending and retracting mechanism wherein a portion of the button protrudes through the push-button hole, the lower end of the thimble and the pen point of the ink cartridge protrude through the outlet of the case, the other end of the thimble is pushed by the spring to sleeve the pen point when the button is released; the thimble is retracted by pushing down the button to expose the pen point and be ready for use.

2. The pen as claimed in claim 1, wherein a slant spring piece is disposed on one side of the thimble under the push button, the lower end of the spring piece can hold out against the end of the push-button hole, and the spring piece can be used as a hook to keep the thimble from being retracted, when the push-button is pressed down, the spring piece will be pushed down at the same time so as to release the hook.

3. The pen as claimed in claim 1, the pen with push button has a slant face at its top, a slot hole is disposed under the slant face, under the slot hole is a hook slot, a groove is disposed in the lower side of the slant face, a pen clip has a head with a slant bottom which fits the slant upper face of the upper barrel, a clip plate extends itself from the lower bottom side downward to fit in the groove, an arc spring piece extends itself from the bottom of the other side, the lower portion of the spring piece is a hook sleeved in the slot hole, its hook can be secured to the hook slot, press the head of the pen clip to move and slide the clip plate out of the clip by means of the slant face so that the clip plate is ready to clip on the pocket.

* * * * *